United States Patent [19]

Bates, Jr.

[11] Patent Number: 4,501,219

[45] Date of Patent: Feb. 26, 1985

[54] TENSIONER APPARATUS WITH EMERGENCY LIMIT MEANS

[75] Inventor: Howard J. Bates, Jr., Houston, Tex.

[73] Assignee: NL Industries, Inc., New York, N.Y.

[21] Appl. No.: 481,809

[22] Filed: Apr. 4, 1983

[51] Int. Cl.[3] ..... E21B 19/08; E21B 19/09

[52] U.S. Cl. ..... 114/264; 91/435; 166/355; 175/5; 175/27; 251/30; 251/206; 254/392; 267/125

[58] Field of Search ..... 114/264, 265; 175/5, 175/7, 27; 254/93 R, 392; 91/404, 405, 406, 91/364, 435; 251/63.5, 206, 30; 267/125, 126; 166/355

[56] References Cited

U.S. PATENT DOCUMENTS

| | | | |
|---|---|---|---|
| 404,726 | 6/1889 | Nickerson | 91/435 |
| 1,212,154 | 1/1917 | Matthews | 91/435 X |
| 1,744,331 | 1/1930 | Pascale | 251/206 X |
| 2,510,356 | 6/1950 | Werts | 251/206 X |
| 3,309,065 | 3/1967 | Prud'homme et al. . | |
| 3,314,657 | 4/1967 | Prud'homme et al. . | |
| 3,785,445 | 1/1974 | Scozzafava | 175/27 X |
| 3,799,505 | 3/1974 | Duncan . | |
| 3,804,183 | 4/1974 | Duncan et al. . | |
| 3,842,603 | 10/1974 | Ditzen . | |
| 3,865,066 | 2/1975 | White et al. . | |
| 3,877,489 | 4/1975 | Louie et al. . | |
| 3,877,680 | 4/1975 | Childs et al. . | |
| 3,908,963 | 9/1975 | Bates et al. . | |
| 4,072,122 | 2/1978 | Balston . | |
| 4,268,013 | 5/1981 | Khan . | |
| 4,351,261 | 9/1982 | Shanks . | |

*Primary Examiner*—Sherman D. Basinger

*Attorney, Agent, or Firm*—Browning, Bushman, Zamecki & Anderson

[57] ABSTRACT

The invention pertains to tensioners for maintaining a load between two relatively movable structures, such as an offshore drill ship or the like and a riser pipe. First and second tensioner bodies are mounted for relative reciprocation, and are further functionally interconnected with the first and second offshore structures respectively. Relative movement of the offshore structures tends to cause corresponding relative reciprocation of the tensioner bodies. A force is applied between the tensioner bodies tending to reciprocate them in a first directional mode and thereby supporting the offshore riser pipe with respect to the offshore support structure. A balancing chamber cooperative between the tensioner bodies communicates with a source of pressurized fluid for resisting reciprocation of the tensioner bodies in the first directional mode, but includes an outlet for egress of the pressurized fluid to permit such reciprocation under controlled conditions. A limit valve is associated with the outlet of the balancing chamber and movable between at least two positions. In a first position, the limit valve communicates a first flow area with the balancing chamber outlet, and in a second position, communicates a second flow area with said outlet. The second flow area is substantially less than the first flow area.

18 Claims, 8 Drawing Figures

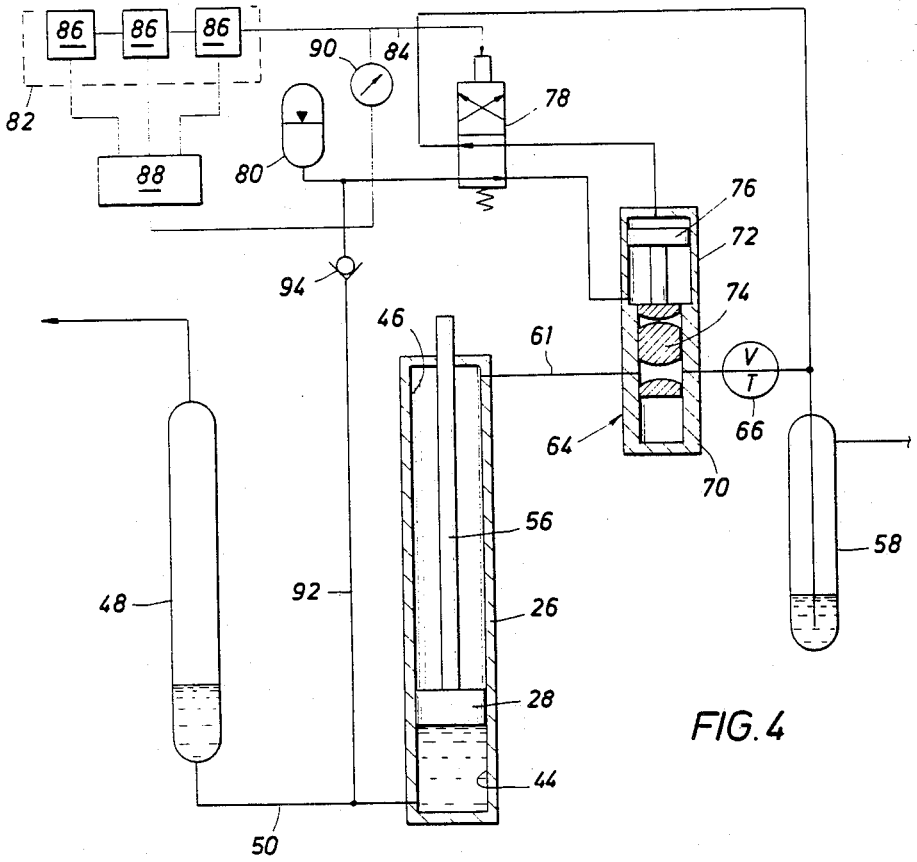
FIG. 4
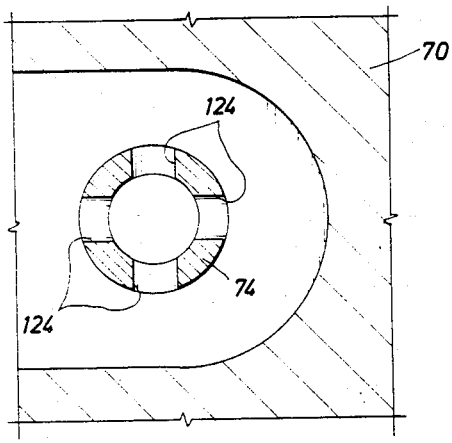
FIG. 6
FIG. 8
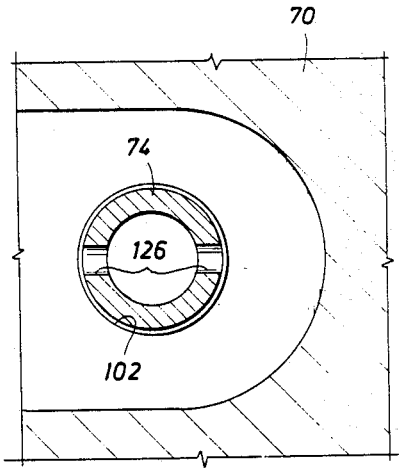

TENSIONER APPARATUS WITH EMERGENCY LIMIT MEANS

BACKGROUND OF THE INVENTION

The present invention pertains to a type of apparatus or system typically referred to as a "tensioner" and is particularly well adapted to those tensioners which are used offshore in connection with marine riser pipe structures. In connection with the drilling and production of offshore oil and gas wells, various operations are typically conducted from a support structure, such as a drill ship or semi-submersible platform, which rises and falls with the wave action. One or more wellheads are located on the floor of the body of water generally beneath this structure. For each such wellhead, a package of equipment, e.g. a stack of blowout preventers, is run into place on a string of relatively large diameter pipe known as riser pipe. After this running in operation, the riser pipe is left in place so that it extends upwardly from the wellhead area to a point above the surface of the water and near the support platform whereby it may serve as a rough guide for other strings of apparatus which must, from time to time, be lowered to the wellhead and/or into the well.

The riser pipe must be supported with respect to the platform or other support structure for several reasons including the prevention of collapse of the riser pipe under its own weight as well as the prevention of excessive swaying motion of the riser pipe in the water. Accordingly, it is customary to support the riser pipe with respect to the platform by placing it under considerable tension, the magnitude of the tension load typically exceeding the weight of the riser pipe.

Maintaining the aforementioned tension load at a given value, or at least within a given range of values, is rendered difficult because of the heaving of the platform or other support structure due to wave action, etc. Thus, the tension cannot be applied by a static or fixed system. U.S. Pat. No. 3,314,657 to Prud'homme et al discloses a typical tensioner system. To the extent that this patent is helpful in understanding the type of apparatus to which the present invention is applied, it is hereby expressly incorporated herein by reference.

Briefly, a typical tensioner, such as that disclosed in the Prud'homme et al patent, includes a piston and cylinder arrangement interconnected between the offshore platform and the riser pipe in such a way that relative movements of the platform and riser pipe tend to cause corresponding relative reciprocation of the piston and cylinder, and conversely, reciprocations of the piston and cylinder tend to cause or at least permit relative movement of the two interconnected offshore structures.

A high pressure fluid is applied against the piston in one end of the cylinder, and it is the force of this pressurized fluid which ultimately supports the riser pipe with respect to the platform and applies the desired tension. The high pressure fluid, or at least a portion thereof, is compressible. More specifically, the body of high pressure fluid may be comprised entirely of a gas, or it may be a suitable liquid, such as oil, backed by a volume of pressurized gas. This permits reciprocation of the piston and cylinder, so as to accommodate relative movement of the platform and riser pipe, while still maintaining the tension load on the riser pipe within a given range of values.

In order to prevent the piston from slamming or jolting action when it reciprocates away from the high pressure end of the cylinder, a lower pressure balancing fluid is admitted into the opposite end of the cylinder. This low pressure fluid may flow into and out of the cylinder to permit the necessary reciprocations of the piston, but its flow rate is controlled by a throttle or the like which slows the piston speed, at least near the end of its stroke, so as to avoid undesirable slamming or jolting during normal operational reciprocations.

One problem which has arisen in connection with the type of tensioner described above occurs when the riser pipe, or a portion thereof, is suddenly disconnected from the wellhead apparatus while the tensioners are still engaged. Such disconnections may occur due to accidents, e.g. failures of the riser pipe itself or some related wellhead apparatus, or through the operation of emergency disconnect systems which are used to disconnect the riser pipe, e.g. in the event of severe weather. Such occurrences cannot be completely avoided, and it is not practicable to disengage the tensioners before disconnection of the riser pipe. In tensioning the riser pipe, the system applies a large vertically upward force. If the riser pipe is disconnected, the tensioners will continue to apply this force, but the riser pipe, no longer anchored to the wellhead, will be raised upwardly toward the platform. The riser pipe will, in effect, be suddenly jerked upwardly at a relatively high rate of speed. The heavy riser pipe can gather such momentum that it will ultimately collide with the platform and may cause serious damage or injury. The particulars of such collision will vary depending upon the location of the support platform with respect to the wave crests and troughs at the time of disconnection of the riser pipe. However, it can be shown that disconnection, at whatever point, can result in a dangerous and expensive collision at virtually any point. As we continue drilling at greater and greater depths, riser pipe structures become heavier, and the potential magnitude of such collisions increases.

The throttling means disclosed in the aforementioned patent to Prud'homme et al merely suffices to cushion the advancing piston toward the end of its stroke during normal operational reciprocation, but will not suffice to control the extremely high speeds and forces which prevail when the heavy and highly tensioned riser pipe is suddenly disconnected from the wellhead.

U.S. Pat. No. 4,351,261 to Shanks discloses a system intended to deal with such emergency conditions, but this system is not entirely satisfactory for several reasons. In the first place, the system of the Shanks patent operates to brake the upward movement of the piston, and thus that of the disconnected riser pipe, by applying a high pressure fluid to what is normally the low pressure end of the tensioner cylinder, or otherwise adjusting or replacing the sources of fluid pressure so as to tend to equalize the pressure on both sides of the piston. This system is accordingly unduly complicated and expensive. Furthermore, the nature of the system is such that it tends to hold the piston in a centered position in the cylinder, whereas in many instances, it would be desirable to permit the piston to advance to the extreme end of its stroke so as to raise the riser pipe structure as high as possible.

SUMMARY OF THE INVENTION

The present invention provides a tensioner apparatus which includes an improved means for limiting or controlling the rate of upward movement of the tensioner piston, and thus the riser pipe structure, in emergency disconnect situations. The system of the present invention, while simple and relatively inexpensive, is highly effective and further desirable in that it permits full stroke upward movement of the tensioner piston, but at a controlled rate of speed so as to avoid or minimize the danger of collision between the disconnected riser pipe being elevated by the tensioners and the relatively heaving support platform or drill ship.

The present invention is further advantageous in that already existing tensioners of a more or less conventional type can be simply and inexpensively modified in accord with the present invention. Furthermore, the invention permits versatility in such modifications in that the emergency limit means of the present invention can be employed either in addition to or in place of existing throttling means.

More specifically, a tensioner apparatus according to the present invention comprises first and second tensioner bodies, such as a cylinder and piston, mounted for relative reciprocable movement, and further functionally interconnected with first and second relatively movable structures (such as an offshore support and a riser pipe) whereby relative movement of said structures tends to cause corresponding relative reciprocation of the tensioner bodies. Means are associated with the tensioner bodies for applying a force between them tending to reciprocate the bodies in a first directional mode and thereby supporting the second structure (riser pipe) with respect to the first structure (platform). A balancing chamber is cooperative between the tensioner bodies and communicates with a source of pressurized fluid for resisting reciprocation of the bodies in the first directional mode. The balancing chamber has outlet means communicated therewith for egress of pressurized fluids so as to permit reciprocation of the tensioner bodies in the first directional mode.

Limit valve means are associated with the outlet means of the balancing chamber and movable between at least two positions. In the first position, the limit valve means communicates a first flow area with the outlet means of the balancing chamber, and in a second such position, communicates a second flow area with said outlet means. Thus, the limit valve is a variable speed valve for varying the rate of fluid flow. If a throttling means is included in the outlet means for the balancing chamber, the first flow area of the limit valve means is greater than or equal to the minimum outlet flow area, as defined by the throttling means, so as not to interfere with normal ingress and egress of fluid with respect to the balancing chamber at the rate permitted by the throttling means. Alternatively, when used as a replacement for the conventional throttling means, the first flow area presented by the limit valve means may be sized so as to provide a desired throttling action on the balancing fluid during normal operations. In any event, the second flow area presented by the limit valve means in its second position is substantially less than the first flow area as well as any additional throttling area which may be provided.

If the riser pipe or other structure being supported by the tensioner is disconnected, the limit valve means will be shifted from its first to second position to drastically reduce the rate of fluid flow out from the balancing chamber. Thus, the piston is permitted to move relative to the cylinder and raise the disconnected riser pipe, but at a limited rate of speed. The piston can eventually move through the full length of its stroke, so as to completely raise the riser pipe, but the slow speed enforced by the limit valve means will substantially reduce or eliminate the possibility of a dangerous or damaging collision between the riser pipe and the support structure.

In preferred embodiments, the two variable volume chambers into which the piston divides the cylinder are, respectively, the aforementioned balancing chamber, and a force application chamber into which high pressure fluid is directed to provide the lifting or support force. An actuator means is operatively associated with the limit valve means to normally maintain the limit valve means in its first position, but selectively shift the limit valve means to its second position. The actuator means, in turn, is responsive to a signal from an external control means. Preferably, this control means includes an accelerometer or the like mounted on the riser pipe structure and operative to emit such a signal automatically if the movements of the riser pipe exceed a predetermined limit. The control means may also include a manual or override-type control and/or could be incorporated in the rig's control system, a remote emergency acoustic system, or the like.

The limit valve itself is particularly well adapted for installation in existing tensioner devices. In at least some such devices, it is particularly convenient to replace an elbow between the normal throttling valve and the low pressure or balancing fluid source with a valve according to the present invention. Accordingly, the valve body may have its flow path defined by two angularly intersecting bores. The valve element is reciprocably mounted in one of the bores for movement between the aforementioned first and second positions. This valve element has a hollow interior portion opening longitudinally therethrough and communicating with said one bore. Lateral ports in the valve element intersecting the hollow interior portion serve to define the aforementioned flow areas. These ports are communicable with the other of the two intersecting bores which define the flow path of the valve body, and the various ports or portions thereof are aligned with or displaced from said flow path in the respective first and second positions so as to achieve the above-described variations in the speed of fluid flow from the balancing chamber.

The limit valve element is preferably reciprocated by its own operator piston enclosed in a cylinder joined to the valve body or housing. The aforementioned actuator may preferably be a solenoid valve or similar valve for alternatively communicating a source of pressurized fluid with opposite sides of the operator piston of the limit valve. The source of high pressure fluid for the force application chamber of the tensioner may be used to charge the source of pressurized fluid controlled by the actuator valve.

Accordingly, it is a principal object of the present invention to provide an improved tensioner apparatus including means for limiting the speed of movement in emergency situations.

Another object of the present invention is to provide such an apparatus including a limit valve associated with the outlet of the balancing chamber and having two different positions permitting two different fluid flow rates therethrough.

A further object of the present invention is to provide such a tensioner apparatus in which the limit valve is automatically shifted from a relatively high flow position to a relatively low flow position in response to excessive movement of the structure being supported by the tensioner.

Still another object of the present invention is to provide such a tensioner apparatus which can be formed by relatively simple modifications of existing systems.

Yet a further object of the present invention is to provide an improved two-speed valve.

Still other objects, features and advantages of the present invention will be made apparent by the following detailed description, the drawings and the claims.

BRIEF DESCRIPTION OF THE DRAWINGS

FIG. 4 is a schematic of a tensioner system in accord with the present invention.

FIG. 6 is a sectional view taken along the line 6—6 in FIG. 5.

FIG. 8 is a cross-sectional view taken along the line 8—8 in FIG. 7.

DETAILED DESCRIPTION OF THE PREFERRED EMBODIMENT

Figure 1:
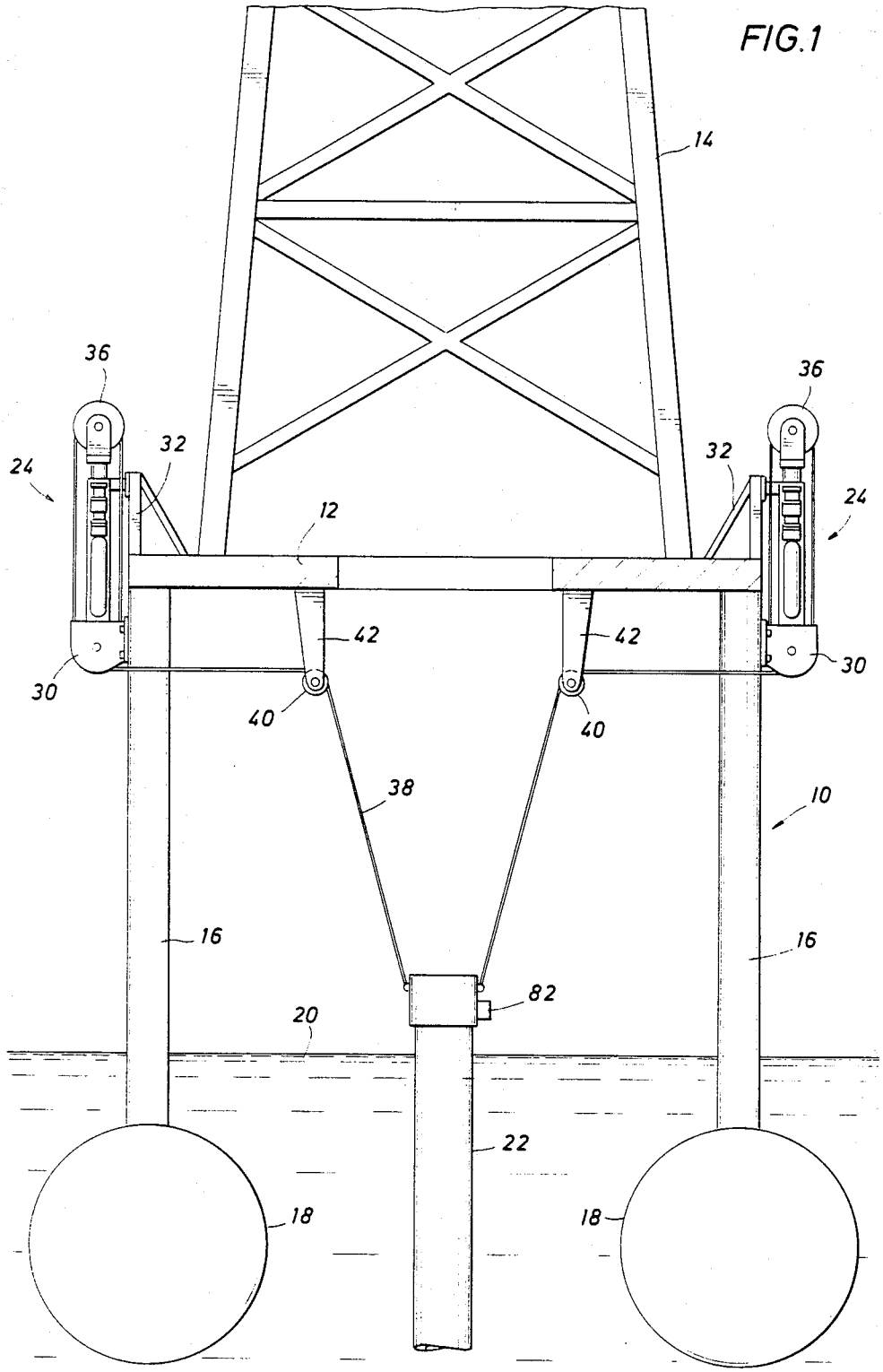
FIG. 1 is a diagrammatic environmental view showing the use of tensioners in accord with the present invention.

Referring first to FIG. 1, there is illustrated an offshore support structure 10 in the form of a semi-submersible type platform. It should be emphasized that the representation of the platform 10 in FIG. 1 is diagrammatic only, and that actual platforms are much more complex and, in addition, carry additional complex apparatus. However, such details have been omitted for simplicity and clarity of illustration. Briefly, the platform structure 10 includes a deck 12 supporting a derrick 14 and numerous other types of apparatus not shown. Deck 12 is carried upon vertical legs 16 which in turn rest upon buoyant pontoon structures 18. Although pontoon structures 18 are designed to ride well below the upper surface of the body of water 20, and although platform 10 would also be moored or anchored, the platform 10 will nevertheless undergo a certain amount of vertical heaving and falling motion in the water 20. FIG. 1 also illustrates the upper portion of a marine riser pipe structure 22 which extends upwardly to a point above the surface of the body of water 20, but below the deck 12 of the support platform. It will be understood that, in accord with principles well known in the art, the riser pipe structure 22 will be affixed to wellhead apparatus at the floor of the body of water 20 (not shown).

FIG. 1 also illustrates a pair of riser tensioners 24 mounted on platform 10 for supporting and tensioning the riser pipe 22. For simplicity, only two tensioners 24 are illustrated, but it will be understood that as many tensioners as necessary or desired can be employed, and that they will normally be symmetrically distributed about the riser pipe 22.

Figure 2:
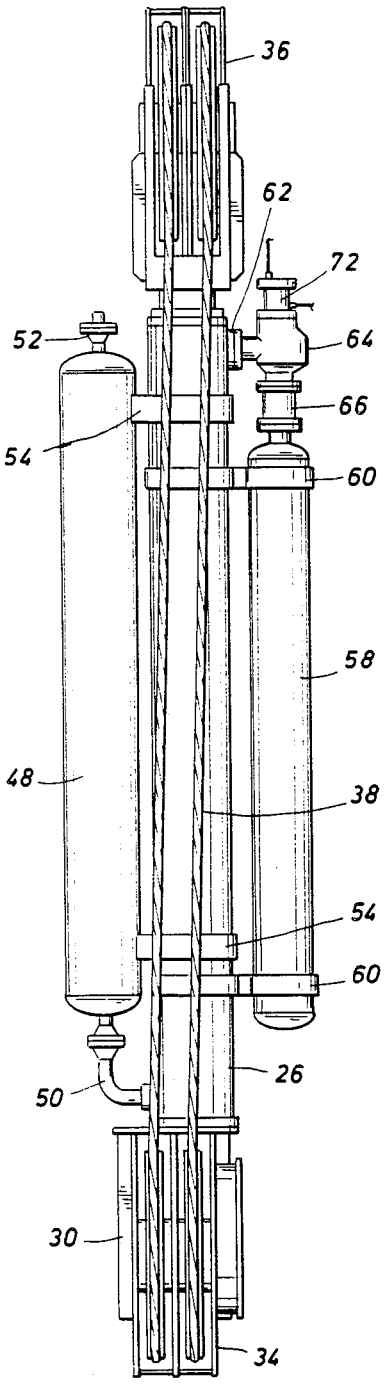
FIG. 2 is an enlarged front elevational view of one of the tensioners of FIG. 1.
Figure 3:
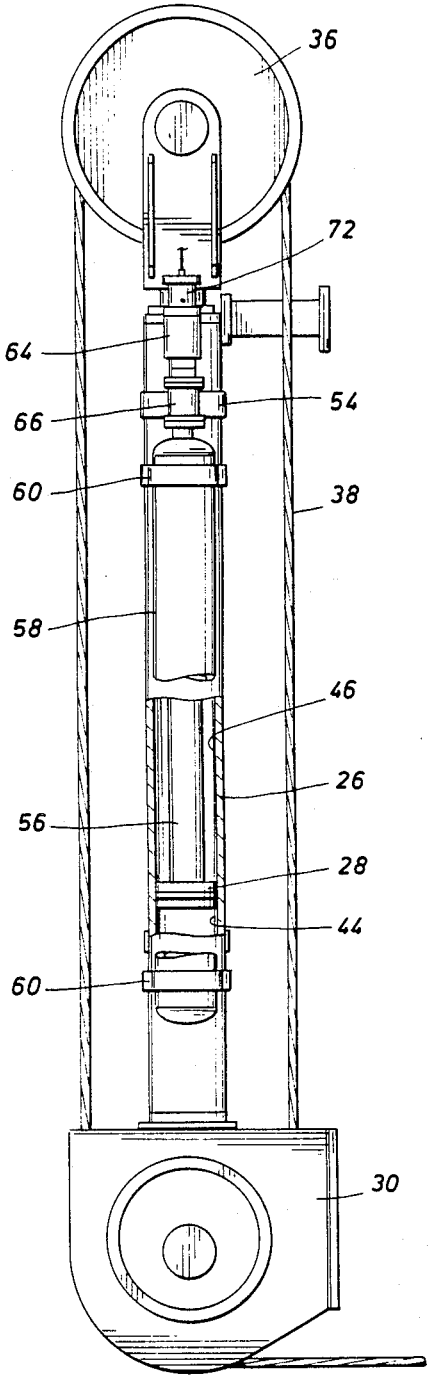
FIG. 3 is a side elevational view of the tensioner of FIG. 2 with parts broken away.

Each of the tensioners 24 comprises a pair of relatively reciprocable tensioner bodies in the form of a cylinder 26 and a piston 28 respectively (see FIGS. 2 and 3). A base block 30 is affixed to the lower end of cylinder 26 as well as to one of the legs 16 of platform 10. The upper end of cylinder 26 is affixed to deck 12 by a bracket structure 32. Thus, cylinder 26 if fixedly mounted on platform 10. Block 30 rotatably mounts a pulley assembly 34 (FIG. 2). The piston rod 56 of piston 28 projects from the upper end of cylinder 26 and carries a second pulley assembly 36. Each of the tensioners has associated therewith a respective cable 38 one end of which is attached to the top of riser pipe structure 22. Each cable 38 extends upwardly and is reaved over a respective pulley 40 carried by bracket 42 mounted on deck 12. From its respective pulley 40, each cable 38 extends to a respective one of the tensioners 24 and is reaved over pulleys 34 and 36 as many times as necessary to provide a desired ratio between the stroke of the piston 28 and the relative movement of structures 10 and 22. Finally, the other end of cable 38 is affixed to platform 10.

It can thus be seen that the cylinder 26 and piston 28 are functionally interconnected with platform 10 and riser pipe 22 respectively, so that relative movements between structures 10 and 22 will tend to cause corresponding reciprocation of cylinder 26 and piston 28. More specifically, cylinder 26 is fixed with respect to platform 10, and will move therewith. Piston 28, for reasons to be developed more fully below, is in a supportive relation with respect to riser pipe 22, and will move therewith. For convenience, throughout this specification, reference may be made to movement of piston 28 or cylinder 26. It should be understood that, unless otherwise indicated, movement of either of these two bodies will mean movement relative to the other of the two bodies. More specifically, unless otherwise indicated, upward movement of piston 28 will include both actual upward movement of the piston and/or downward movement of cylinder 26, and all such relative movements will be referred to as movements or reciprocations in a "first directional mode." Likewise, downward movement of piston 28 will, unless otherwise indicated, also include upward movement of cylinder 26, i.e. will include any and all movements in a "second directional mode" opposite to the first directional mode.

The tensioners 24 are identical, and thus only one of them will be illustrated and described in detail, with specific reference to FIGS. 2, 3 and 4. Piston 28 divides cylinder 26 into two variable volume chambers 44 and 46. The lower chamber 44, at the closed end of cylinder 26, communicates with an accumulator bottle 48 for high pressure fluid by means of a conduit 50. Bottle 48 may conveniently be mounted on cylinder 26 by brackets 54. By a fitting 52 at its opposite end, accumulator bottle 48 may be connected to a compressor or the like through a line with intermediate pressure regulating devices, pressure relief devices, etc., in the well known manner. Chamber 44 thus serves as a force application chamber whereby the high pressure fluid exerts a lifting action on piston 28, i.e. tends to reciprocate piston 28 and cylinder 26 in the first directional mode. This force acts against the weight of the riser pipe 22 pulling downwardly on piston 28 through pulley assembly 36 and piston rod 56. The pressure in bottle 48 in chamber 44 is adjusted to impart a given lifting load on riser pipe structure 22, which load exceeds the mere weight of the riser pipe structure and places that structure in considerable tension.

The high pressure fluid in bottle 48 and chamber 44 may consist entirely of a compressed gas, or, as shown, may consist of a volume of oil filling chamber 44 and the lower portion of bottle 48, and backed by a compressed gas in the upper portion of bottle 48. In either case, should platform 10 heave upwardly, cylinder 26 may reciprocate upwardly with respect to piston 28 by virtue of further compression of the gas in bottle 48 and egress of fluid from chamber 44 through line 50 into bottle 48. When platform 10 moves downwardly, the pressure of the gas in bottle 48 will force fluid back into the then-expanding chamber 44 to maintain a suitable lifting force on piston 28. Thus, while accommodating the relative movement of structures 10 and 22, the tensioner maintains the load on structure 22 generally at a given value, or within a given range of values.

When the piston 28 and cylinder 26 reciprocate in the aforementioned first directional mode, the piston 28 could slam or jolt toward the end of its stroke were it not balanced or dampened. For this purpose, the upper chamber 46 in cylinder 26 communicates with an accumulator bottle 58 carried on cylinder 26 by brackets 60. Bottle 58 contains fluid which is pressurized, but to a much lower value than the fluid in bottle 48. The pressure need only be sufficient to cause the fluid to flow into chamber 46 when that chamber is expanding. When chamber 46, which will be referred to herein as the balancing chamber, is contracting, i.e. when the piston and cylinder are reciprocating in the first directional mode, fluid may flow back from chamber 46 to bottle 58 through an outlet line 61 including a port 62 in the upper end of cylinder 26 and valves 64 and 66 arranged in series.

At any appropriate point in outlet line 61, there may be provided a throttling means which, in the manner well known in the art, defines the minimum flow area of the outlet line during normal operation. That part of the fluid flow path from cylinder 26 to accumulator 58 which defines the smallest effective flow area will in effect serve as such throttling means. For example, the throttling means could be the outlet port 62 of cylinder 26, an orifice plate mounted near the cylinder outlet, an outlet conduit, or a throttling valve arranged in series with valves 64 and 66. For purposes of the present discussion, the outlet port 62 of cylinder 26 may be considered the throttling means. The flow area defined by the throttling means restricts the rate of flow sufficiently to cushion or retard reciprocation of the piston and cylinder in the aforementioned first directional mode so as to prevent slamming or jolting action.

Still referring to FIG. 4, the two accumulator bottles 48 and 58 each contain a volume of oil pressurized by a volume of gas in the upper portion of the bottle. Chambers 44 and 46 take suction from the lower ends of their respective accumulator bottles 48 and 58, so that the oil is used to fill the chambers 44 and 46 and pressurized by the volumes of compressed gas.

Valve 64, referred to herein as a "limit value," is a two-speed variable valve movable between a first position, shown in FIG. 4, permitting a relatively high rate of flow therethrough, and a second position permitting only a much lower rate of flow therethrough. More specifically, in each of its two positions, valve 64 defines a respective flow area and communicates that flow area with outlet line 61. In the first or high flow position, the flow area defined by valve 64 is greater than or equal to the minimum flow area defined by any throttling means employed, e.g. ports 62. Thus, valve 64 in no way interferes with the ordinary operation of the system when in its first position. However, in its second position, valve 64 defines a flow area therethrough which is substantially less than its first flow area and also substantially less than the minimum flow area defined by the throttling means. Thus, in its second position, valve 64 will more drastically limit the rate of fluid flow outwardly from chamber 46 and, thus, the speed with which piston 28 and cylinder 26 may reciprocate in the first directional mode. This in turn limits the speed with which piston 28 can raise riser pipe structure 22 if the latter is disconnected from the wellhead.

Valve 64 is a fluid operated valve including a valve body 70 connected to an operator cylinder 72 and a reciprocable valve element 74 connected to an operator piston 76 dividing cylinder 72 into a pair of variable volume chambers. Piston and cylinder 76 and 72 are of the double acting type, and are controlled by a solenoid type actuator valve 78. Valve 78 is normally spring biased to the position shown in FIG. 4 in which it serves to admit pressurized actuating fluid from a source 80 to the underside of piston 72 and to vent the upper side of piston 72 to low pressure accumulator bottle 58. Upon receipt of a suitable electrical signal, when riser pipe 22 is broken or disconnected, solenoid valve 78 will be triggered and move against the bias of its spring to admit pressure from source 80 to the upper side of piston 76 and vent the underside. This will move valve element 74 into the aforementioned second or low flow position.

Valve 66 is a shut-off valve for completely closing line 61, e.g. as needed to perform repairs on the system.

The control signal for actuator valve 78 is preferably provided automatically by a control unit 82 (see also FIG. 1) which is carried on the upper end of the riser pipe structure 22. Control unit 82 includes means for detecting acceleration of pipe structure 22 in excess of a predetermined limit (although it might also be possible to employ means for detecting movement of pipe 22 beyond a given position, or even some other variable functionally related to disconnection of the riser pipe structure from the wellhead). When such excess movement is detected, control unit 82 emits a suitable signal for actuating solenoid valve 78. The signal may be electrical, sonar, or any other suitable type. Thus, solenoid valve 78 may be physically connected to control unit 82 by hardware-type electrical line 84, but is, in any event, adapted to receive the type of signal produced. As a failsafe measure, control unit 82 may in fact include a plurality of accelerometers 86, and these accelerometers are powered by a suitable source 88 already present on platform 10. Source 88 may also power a manual control or override device 90 whereby an operator may selectively transmit the signal to valve 78 to cause switching of valve 64 into its second or low flow position.

Additional or alternative control means could be provided for emitting a signal to valve 78, especially when the riser pipe is voluntarily disconnected. For example, such control means could be incorporated in the overall rig control logic and/or in an acoustic system used to control rig functions from a remote location. However, in preferred systems, the control means includes at least one signal source directly responsive to riser pipe movements for operating valve 78 in the event of breakage or other accidental disconnection of the riser.

Source 80 of actuating fluid may conveniently be connected with high pressure fluid source 48 as indicated by line 92, so that fluid from source 48 may charge source 80. A check valve 94 in line 92 prevents backflow of fluid from source 80 to bottle 48.

It can be seen that more or less conventional tensioner devices can readily be modified in accord with the present invention. In particular, it is merely necessary, for example, to replace an elbow fitting normally connecting shut-off valve 66 to outlet port 62 with limit valve 64. Associated parts 78, 80, 90, and 82 are mounted in suitable locations externally of the original tensioner apparatus. Parts 78, 80 and 90, in particular, could be provided in a unitary package with valve 64. Line 92 may be connected to bottle 48, e.g. through line 50, but even this slight modification is not necessary since bottle 80 could be charged from another source.

As noted, if the original apparatus included throttling means for controlling speed of movement of piston 28 toward the upper end of its stroke during normal operations, limit value 64 will not interfere with the normal functions of those means. However, if desired, such throttling means can be eliminated from the system, and limit valve 64 can be designed to provide the desired throttling action during normal operation by a suitable choice of the first flow area defined through valve 64 when it is in its first or high flow position.

Referring now to FIGS. 5–8, limit valve 64 is shown in greater detail. As mentioned, in many tensioners, valve 64 may conveniently replace an existing elbow fitting. Accordingly, valve body 70 is designed with an inlet 96 and an outlet 98 oriented at right angles to each other. It should be noted that the terms "inlet" and "outlet" are used for convenience, but are somewhat arbitrary in that, at various times during the operation of the system, fluid will flow in opposite directions through each of these two openings. Thus, the terms should not be construed in a limiting sense.

Inlet 96 and outlet 98 are continuous with respective intersecting bores 100 and 102 defining the flow paths through the valve body 70. The upper end of bore 102 is threaded to receive a closure member 104. The lower end of member 104 extends partially into bore 100 and defines a sliding guide for the upper end of valve element 74, the lower end being slidably guided in the lower part of bore 102. The upper portion of closure member 104 defines a stuffing box through which extends a valve stem 106 connected to valve element 74 and also serving as a piston rod for operator piston 76. A packing gland 108 connected to the upper side of member 104 bears on packing rings 110 via washer 112 to seal against rod 106. The upper end of member 104 also includes a radially outwardly extending flange against which cylinder 72 is clamped by means of tie rods 114 and upper cylinder head 116. Cylinder head 116 has a port 118 for transmitting actuating fluid to and from the upper side of operator piston 76, and cylinder 72 has a port 120 for similarly serving the underside of piston 76.

Valve element 74 has a hollow portion 122 opening longitudinally downwardly into bore 102 of the valve body. Valve element 74 further has a series of four relatively large diameter lateral ports 124 intersecting the lower part of hollow 122, and a second series of two relatively small diameter ports 126 intersecting the upper portion of hollow 122.

Figure 5:
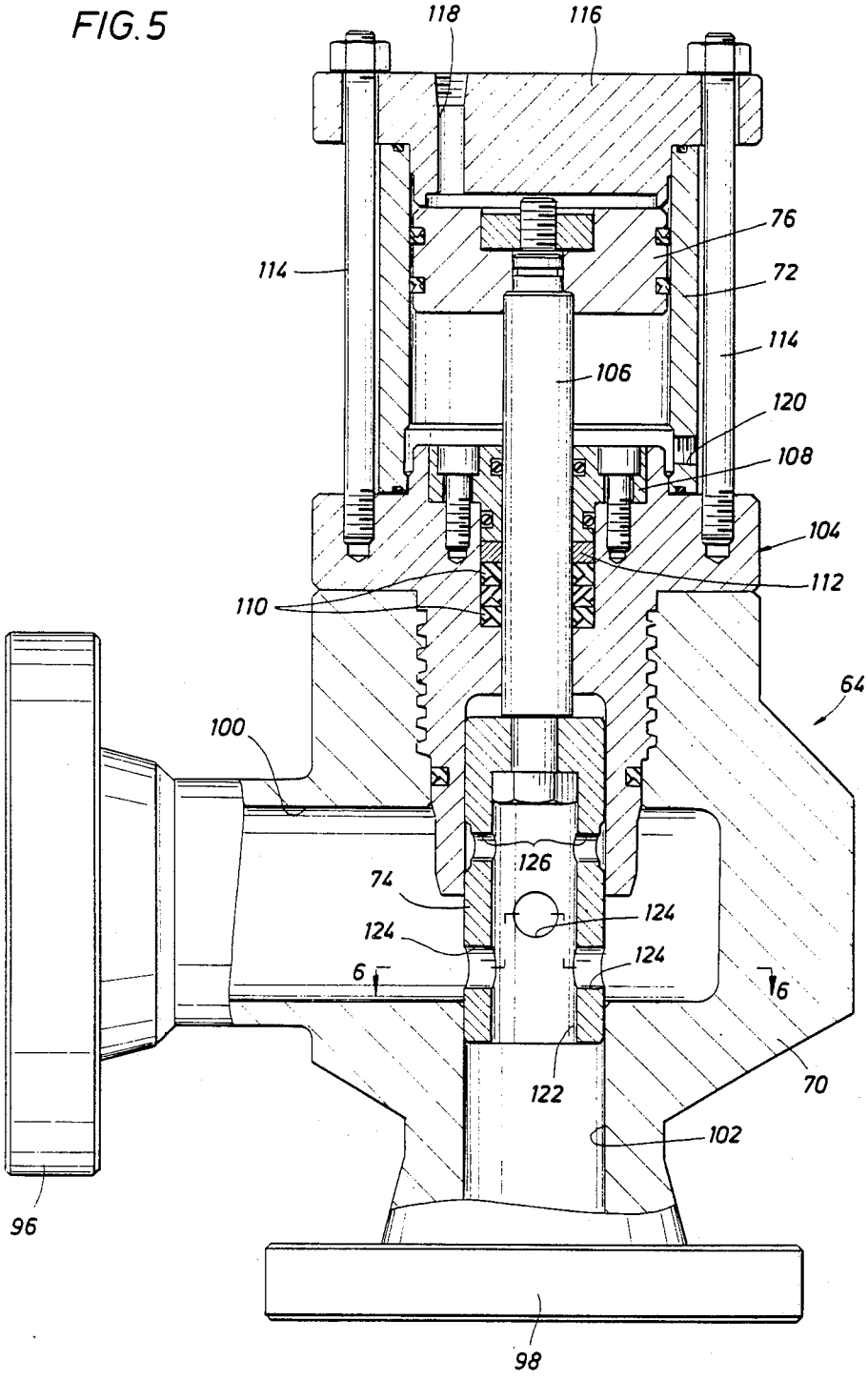
FIG. 5 is a further enlarged cross-sectional view of the limit valve in high flow position.
Figure 7:
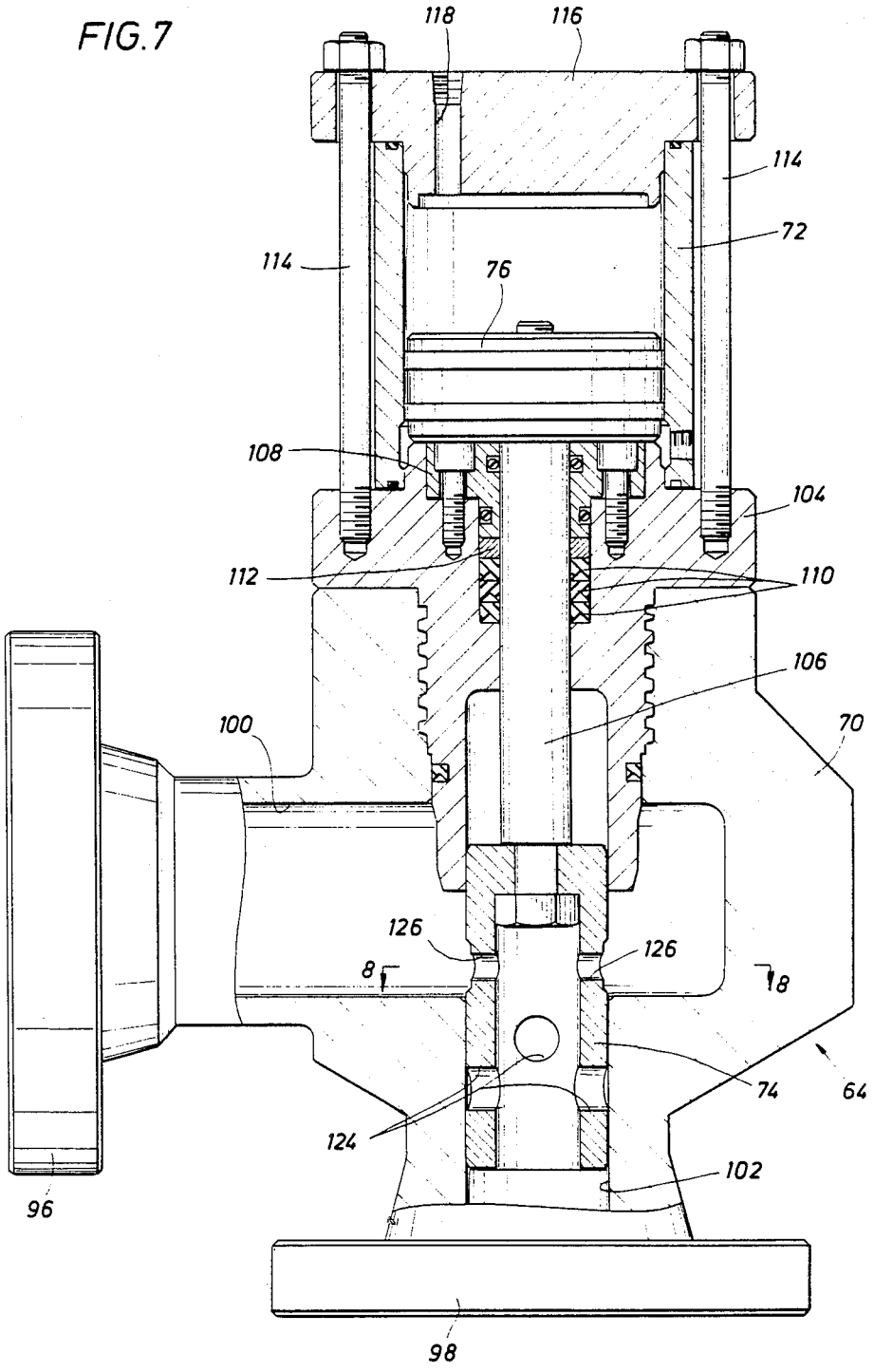
FIG. 7 is a view similar to FIG. 5 showing the limit valve in low flow position.

Because bore 100 is of larger diameter than bore 102, it defines a free space about the entire circumference of valve element 74. When valve element 74 is in its first or high flow position as shown in FIG. 5, all four of the relatively large diameter ports 124 are aligned with bore 100 in the valve body. Thus, the aforementioned first flow area communicated with the outlet line 61 of the balancing chamber of the tensioner during normal operation is the combined cross-sectional area of ports 124. Fluid may flow freely from bore 100 into all four of the ports 124, thence into hollow 122, and finally into the lower part of bore 102. Ports 126 are blocked by the lower portion of member 104 which extends downwardly into bore 100. When the valve element 74 moves into its second or low flow position as shown in FIG. 7, ports 124 are moved downwardly out of alignment with bore 100 and are blocked from free flow by the lower portion of bore 102 in which they are then encased. However, ports 126 have now been brought into alignment with bore 100. Thus, flow of fluid is still permitted from bore 100, through ports 126, into hollow 122, and thence into bore 102, but at a much slower rate determined or limited by the total cross-sectional area of the two ports 126.

Numerous modifications of the valve 64 are contemplated. For example, as illustrated, the valve uses two distinct sets of lateral ports in the valve element to define the first and second flow areas respectively. However, in other embodiments, the lateral ports might be in the form of elongate slots greater and lesser portions of which would be aligned with bore 100 in the first and second positions respectively. Where distinct sets of ports are used to define the first and second flow areas, these areas may be varied either by means of the size of the ports in the respective sets, the number of ports in the respective sets, or both. It can also be appreciated that, while a minimum of two positions are required for valve 64, the valve could be designed to provide a number of different positions or to provide a continuously varying flow rate. Likewise, valve 64 has been designed, for convenience, to replace a 90° elbow fitting. However, other designs are possible, e.g. to provide a straight line flow path through the valve.

Still other modifications of the overall tensioner apparatus are envisioned within the spirit of the present invention. Accordingly, it is intended that the scope of the invention be limited only by the claims which follow.

What is claimed is:

1. Tensioner apparatus for maintaining a load between an offshore support structure and a marine riser pipe structure comprising:

first and second tensioner bodies, one of said tensioner bodies comprising a cylinder and the other of said tensioner bodies comprising a piston dividing said cylinder into two variable volume chambers, said first and second tensioner bodies being functionally interconnected with said offshore support structure and said marine riser pipe structure respectively whereby relative movement of said structures tends to cause corresponding relative reciprocation of said tensioner bodies, one of said variable volume chambers of said cylinder communicating with a source of pressurized fluid at a relatively high pressure for applying a force between said piston and cylinder tending to reciprocate said piston and cylinder in a first directional mode and thereby applying a generally upwardly directed tensile force to said riser pipe structure, and the other of said variable volume chambers being a balancing chamber communicating with a source of pressurized fluid at a relatively low pressure for resisting reciprocation of said piston and cylinder in said first directional mode, said balancing chamber having outlet means communicating therewith for egress of pressurized fluid from said balancing chamber so as to permit reciprocation of said tensioner bodies in said first directional mode;

limit valve means associated with said outlet means of said balancing chamber and movable between at least two positions, said limit valve means in a first such position communicating a first flow area with said outlet means, and in a second such position communicating a second flow area with said outlet means, said second flow area being substantially less than said first flow area, so as to reduce the rate of fluid flow from the balancing chamber;

actuator means operatively associated with said limit valve means for normally maintaining said limit valve means in said first position but selectively shifting said limit valve means to said second position on receipt of a signal;

and control means functionally associated with said riser pipe structure and said actuator means for detecting movement of said riser pipe structure independently of the corresponding relative reciprocation of said tensioner bodies in excess of a predetermined limit and producing such signal in response to such movement.

2. The apparatus of claim 1 wherein said cylinder is fixedly mounted on said offshore support structure.

3. The apparatus of claim 1 further comprising throttling means associated with said outlet means of said balancing chamber in series with said limit valve means and defining a minimum flow area for said outlet means; said first flow area of said limit valve means being greater than or equal to said minimum flow area, and said second flow area of said limit valve means being substantially less than said minimum flow area.

4. The apparatus of claim 1 wherein said control means is connected to said riser pipe structure.

5. The apparatus of claim 4 wherein said control means comprises an accelerometer.

6. The apparatus of claim 5 wherein said control means further comprises manually operable means for producing such signal.

7. The apparatus of claim 1 wherein said control means further comprises manually operable means for producing such signal.

8. The apparatus of claim 1 wherein said limit valve means comprises a valve body defining a flow path therethrough and a valve element mounted in said valve body for movement between said first and second positions, said limit valve means further comprising an operator piston and cylinder connected to said valve element and said valve body respectively; and wherein said actuator means comprises an actuator valve for communicating a source of actuating fluid alternatively with opposite sides of said operator piston.

9. The apparatus of claim 1 wherein the source of pressurized fluid for said force applying means communicates with said source of actuating fluid to charge said source of actuating fluid.

10. The apparatus of claim 9 wherein said actuator valve comprises a spring loaded solenoid valve, and said signal is electrical.

11. The apparatus of claim 1 wherein said limit valve means comprises a valve body defining a flow path therethrough and a valve element mounted in said flow path for reciprocation between said first and second positions, said valve element having first and second flow restrictor means defining said first and second flow areas respectively, said first flow restrictor means being aligned with said flow path in said first position and blocked from said flow path in said second position, and said second flow restrictor means being aligned with said flow path in said second position.

12. The apparatus of claim 11 wherein said valve body has two angularly intersecting bores defining said flow path, said valve element being reciprocably mounted in one of said bores and having a hollow interior portion opening longitudinally through said valve element and communicating with said one bore, said valve element further having lateral ports forming said flow restrictor means, said lateral ports intersecting said hollow interior and being communicable with the other of said bores of said valve body.

13. The apparatus of claim 12 wherein said limit valve means further comprises an operator piston and cylinder connected to said valve element and said valve body respectively.

14. The apparatus of claim 1 wherein said limit valve means comprises a valve body having two angularly intersecting bores defining a flow path therethrough, and a valve element reciprocably mounted in one of said bores for movement between said first and second positions, said valve element having a hollow interior portion opening longitudinally through said valve element and communicating with said one bore and lateral port means intersecting said hollow interior portion and communicable with the other of said bores, a relatively larger portion of said lateral port means being aligned with said other bore in said first position to define said first flow area, and a relatively smaller portion of said lateral port means being aligned with said other bore in said second position to define said second flow area.

15. The apparatus of claim 14 wherein said limit valve means further comprises an operator piston and cylinder connected to said valve element and valve body respectively.

16. Tensioner apparatus comprising:

a cylinder;

a piston dividing said cylinder into two variable volume chambers, one of said chambers communicating with a source of relatively high pressure fluid tending to reciprocate said piston and cylinder in a first directional mode whereby said one chamber may serve as a force application chamber, and the other of said chambers communicating with a source of relatively low pressure fluid for resisting relative reciprocation of said piston and cylinder in said first directional mode whereby said other chamber may serve as a balancing chamber, said balancing chamber having outlet means for egress of pressurized fluid from said balancing chamber to permit relative reciprocation of said piston and cylinder in said first directional mode;

and limit valve means associated with said outlet means of said balancing chamber and movable between at least two positions, said limit valve means in a first such position communicating a first flow area with said outlet means and in a second such position communicating a second flow area with said outlet means, said second flow area being substantially less than said first flow area, said limit valve means comprising a valve body defining a flow path therethrough and a valve element mounted in said valve body for movement between said first and second positions, said limit valve means further comprising an operator piston and cylinder connected to said valve element and said valve body respectively;

actuator means operatively associated with said limit valve means for normally maintaining said limit valve means in said first position but selectively shifting said limit valve means to said second position, said actuator means comprising an actuator valve for communicating a source of actuating fluid alternatively with opposite sides of said operator piston;

and a source of pressurized fluid communicating with said force application chamber and with said source of actuating fluid.

17. The apparatus of claim 16 further comprising throttling means associated with said outlet means of said balancing chamber in series with said limit valve means and defining a minimum flow area for said outlet means; said first flow area of said limit valve means being greater than or equal to said minimum flow area, and said second flow area of said limit valve means being substantially less than said minimum flow area.

18. The apparatus of claim 16 wherein said actuator means is adapted to so shift said limit valve means to said second position on a receipt of a signal from a control means operatively associated with said actuator means.

* * * * *